US005500193A

United States Patent [19]

Benson et al.

[11] Patent Number: 5,500,193

[45] Date of Patent: Mar. 19, 1996

[54] METHOD FOR ION EXCHANGE BASED LEACHING OF THE CARBONATES OF CALCIUM AND MAGNESIUM FROM PHOSPHATE ROCK

[75] Inventors: Robert F. Benson, St. Petersburg; Dean F. Martin, Tampa, both of Fla.

[73] Assignee: University of South Florida, Tampa, Fla.

[21] Appl. No.: 306,810

[22] Filed: Sep. 15, 1994

Related U.S. Application Data

[63] Continuation-in-part of Ser. No. 76,578, Jun. 14, 1993, abandoned.

[51] Int. Cl.[6] ..... C22B 26/00; C22B 26/20

[52] U.S. Cl. ..... 423/157; 423/157.2

[58] Field of Search ..... 423/157, 157.2, 423/321.1; 209/3

[56] References Cited

U.S. PATENT DOCUMENTS

| | | | |
|---|---|---|---|
| 3,993,466 | 11/1976 | Knudson | 423/319 |
| 4,242,198 | 12/1980 | Hill | 423/321.1 |
| 4,363,880 | 12/1982 | Whitney et al. | 210/677 |
| 4,557,909 | 12/1985 | Mair | 423/157.2 |
| 4,723,998 | 2/1988 | O'Neil | 423/24 |
| 4,793,979 | 12/1988 | Wenxing | 423/157.2 |
| 4,857,174 | 8/1989 | Moudgil et al. | 209/3 |
| 4,861,490 | 8/1989 | Morris | 423/356 |
| 4,894,168 | 1/1990 | Holl et al. | 210/687 |
| 4,981,598 | 1/1991 | Komadina | 423/25 |
| 5,021,216 | 6/1991 | Whitney et al. | 210/677 |

*Primary Examiner*—Steven Bos
*Attorney, Agent, or Firm*—Dominik & Stein

[57] ABSTRACT

This invention relates to the extraction of carbonates of magnesium and/or calcium with a strong hydrogen form cation-exchange resin from a phosphate rock composition in an aqueous slurry, wherein the phosphate rock and the resins have been classified to different non-overlapping particle sizes and separating the slurry into the leached composition and the loaded ion exchange resin; and recovering the calcium and magnesium, and regenerating the ion exchange resin for further use in the process.

6 Claims, 1 Drawing Sheet

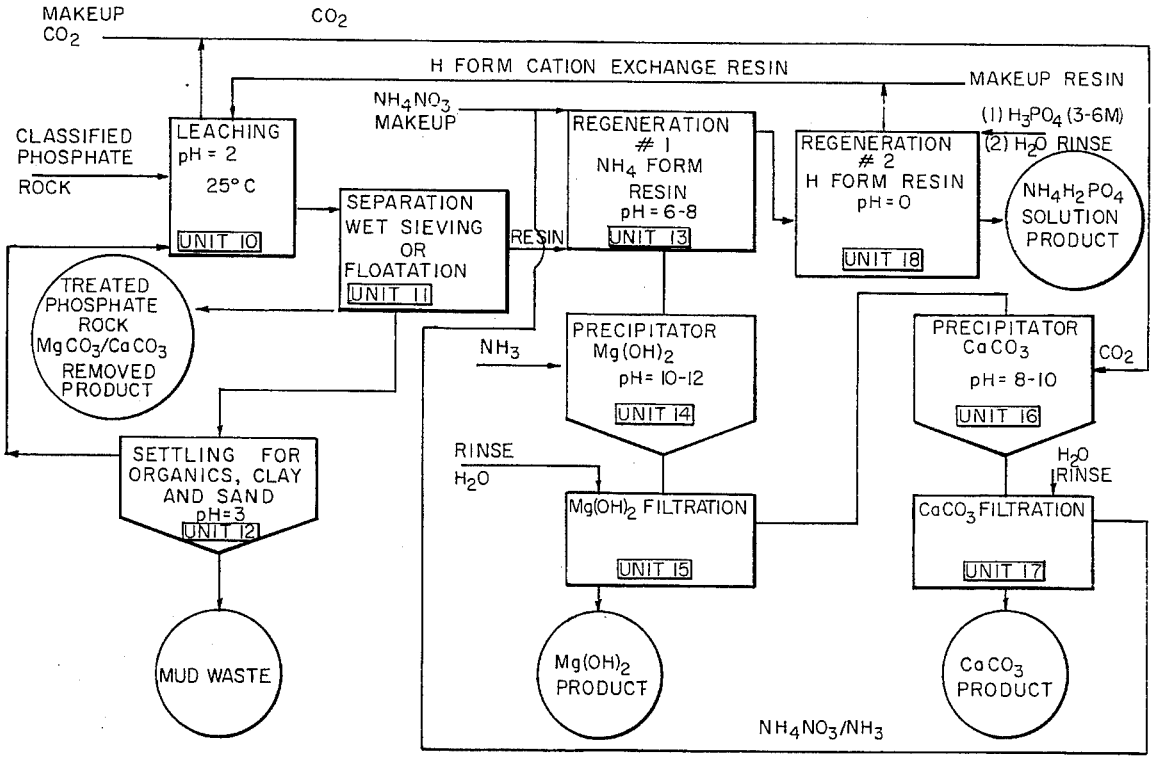

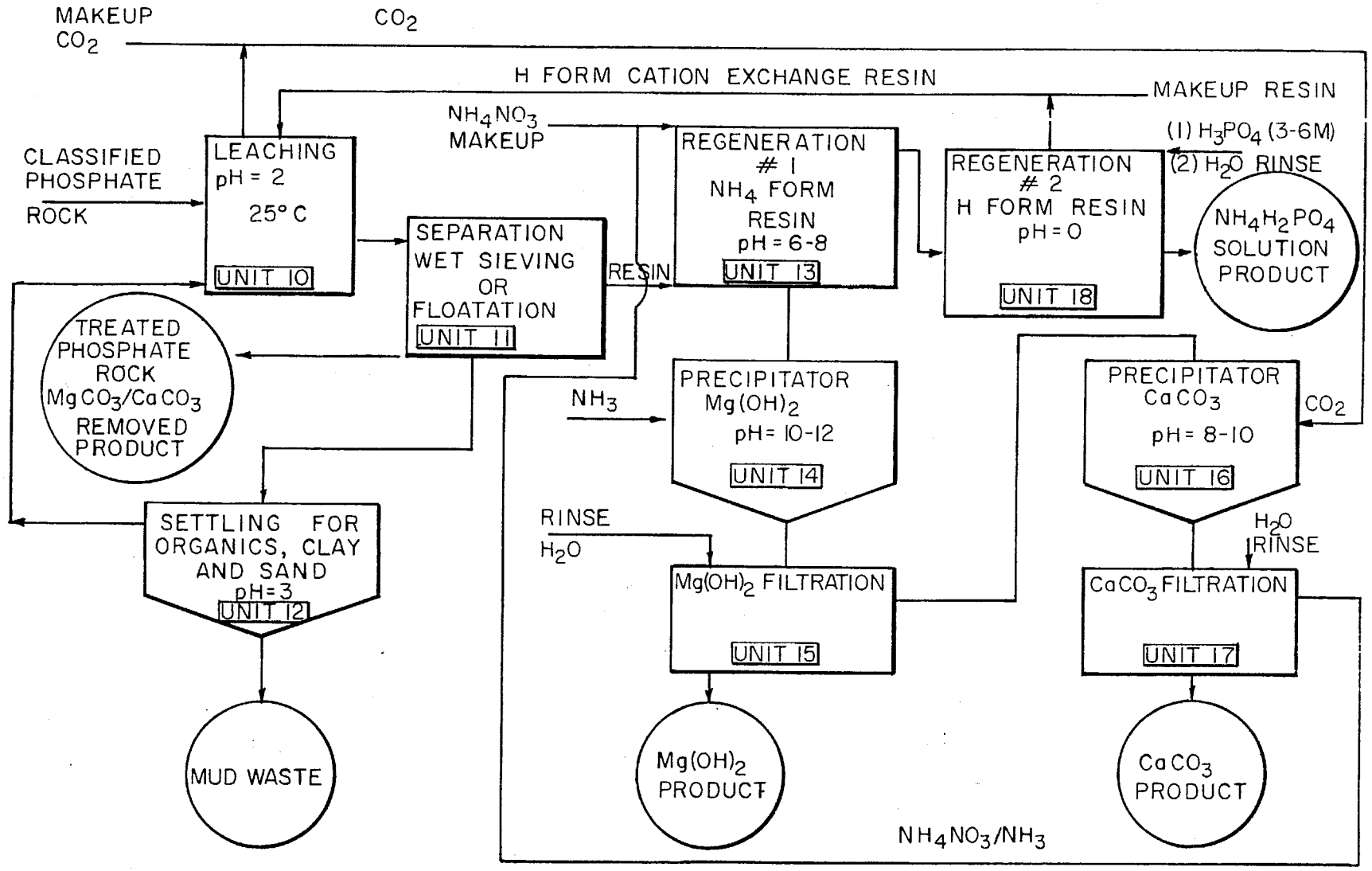
MAKEUP CO2
CO2
CLASSIFIED PHOSPHATE ROCK
LEACHING pH = 2 25° C UNIT 10
NH4NO3 MAKEUP
H FORM CATION EXCHANGE RESIN
MAKEUP RESIN
(1) H3PO4 (3-6M)
(2) H2O RINSE
SEPARATION WET SIEVING OR FLOATATION UNIT 11
RESIN
REGENERATION # 1 NH4 FORM RESIN pH = 6-8 UNIT 13
REGENERATION # 2 H FORM RESIN pH = 0 UNIT 18
NH4H2PO4 SOLUTION PRODUCT
TREATED PHOSPHATE ROCK MgCO3/CaCO3 REMOVED PRODUCT
SETTLING FOR ORGANICS, CLAY AND SAND pH=3 UNIT 12
MUD WASTE
PRECIPITATOR Mg(OH)2 pH = 10-12 UNIT 14
NH3
RINSE H2O
Mg(OH)2 FILTRATION UNIT 15
Mg(OH)2 PRODUCT
PRECIPITATOR CaCO3 pH = 8-10 UNIT 16
CO2
H2O RINSE
CaCO3 FILTRATION UNIT 17
CaCO3 PRODUCT
NH4NO3/NH3

METHOD FOR ION EXCHANGE BASED LEACHING OF THE CARBONATES OF CALCIUM AND MAGNESIUM FROM PHOSPHATE ROCK

CROSS-REFERENCE TO RELATED APPLICATIONS

This application is a continuation-in-part application of Ser. No. 08/076,578 filed Jun. 14, 1993, now abandoned.

FIELD OF THE INVENTION

This invention relates to the extraction of carbonates of magnesium and/or calcium from a phosphate rock composition in an aqueous slurry by means of a strong hydrogen form cation-exchange resin and wherein the phosphate rock and the resins have been classified to different non-overlapping particle sizes and separating the slurry into the leached composition and the loaded ion exchange resin.

BACKGROUND OF THE INVENTION

Calcium and magnesium carbonates are usually found in close association with the calcium phosphate in the phosphate rock. During processing with sulfuric acid to produce phosphoric acid and diammonium phosphate from the phosphate rock, these carbonates substantially contribute to processing problems and degrade product quality. The carbonates cause excessive foaming by releasing carbon dioxide during acidulation treatment of the rock, Calcium carbonate is converted to gypsum which further increases the amount of waste generated and increases the consumption of sulfuric acid, Magnesium carbonate causes more serious problems during acidulation, It forms an impurity in the dilute phosphoric acid that degrades both the phosphoric acid and diammonium phosphate products. It modifies the crystallization of gypsum such that the filtration of the acid product from the gypsum waste becomes much more complicated. It also increases the consumption of sulfuric acid.

The state of the art for avoiding the problems caused by magnesium carbonate and to a lesser extent calcium carbonate impurities in phosphate rock rely on the following approaches. Rock having an undesirable level of magnesium carbonate (>1% MgO basis) tends to be avoided during mining. Floatation type of beneficiation is used to concentrate the bone phosphate levels (BPL refers to tricalcium phosphate) in the rock while separating clay, sand and to much lesser extent the calcium and magnesium carbonates. Floatation separation selectivity between the carbonates and phosphates is limited. In order to keep the carbonate content in the phosphate rock to manageable levels, a large loss of phosphate values in the ore is accepted as part of a tradeoff to gain a low magnesia and high bone phosphate level feedstock for acidulation processing.

In the wet process for producing phosphoric acid, phosphate rock is digested with concentrated sulfuric acid. The resulting phosphoric acid contains metal impurities in which it may be desirable to remove or reduce these metal concentrations before the phosphoric acid is converted into fertilizers. Magnesium is a particularly troubling contaminant. High concentrations of magnesium in phosphoric acid prohibit the formulation of various grades of fertilizer which are necessary for agricultural crops.

The magnesium problem is becoming acute because a large part of the remaining phosphate rock reserves in the United States, as well as in other countries, contains unacceptably high levels of magnesium. If such phosphate rock is used to prepare phosphoric acid, the acid will contain so much magnesium that it cannot be used for high grade fertilizers. One expedient has been to blend a high magnesium phosphate rock with phosphate rock of lower magnesium content, but this is a limited and temporary answer to the problem.

PRIOR ART

Systems employing cation-exchange resins for removing metal ions have been proposed for phosphoric acid purification treatment from wet process phosphate rock. A particular objective of such systems is the reduction of the content of magnesium in the acid. Desirably, other metal ions are also reduced, especially calcium. For removal of calcium and magnesium ions on the cation-exchange resin employed in the acid treatment, regeneration procedures are employed, e.g., see U.S. Pat. Nos. 4,363,880, 4,861,490, 4,894,168, and 5,021,216.

SUMMARY OF THE INVENTION

This invention provides a process for the extraction of the carbonates of magnesium and calcium from phosphate rock preferably using carbonic acid generated in situ along with a strong hydrogen form cation-exchange resin which comprises the steps of: (1) classifying the phosphate rock and the ion exchange resin into substantially non-overlapping particle size distributions; (2) forming an aqueous slurry of the phosphate rock and the resin; (3) agitating the slurry under controlled conditions for release of carbon dioxide; (4) separating the slurry into the leached phosphate rock composition, and the loaded ion exchange resin and an aqueous solution of dissolved calcium and magnesium salts. Additionally, the magnesium and calcium that are loaded onto the ion exchange resin can be transformed into relatively pure compounds and the ion exchange resin regenerated to be recycled to the process.

DETAILED DESCRIPTION

As a pretreatment step to acidulation this process provides a means to a higher quality phosphate rock or pebble that is not presently available. Specifically, the carbonates of magnesium and calcium are removed before acidulation of the phosphate pebble or rock, thus avoiding many of the problems encountered in conventional fertilizer production. The pretreatment process provides three advantages over conventional phosphoric acid production without pretreatment. These advantages are as follows:

- Upgrades phosphate pebble not presently suitable for fertilizer production to acceptable levels, thus extending reserves of phosphate rock.
- Provides by-products that have commercial value rather than become part of the acidulation process waste.
- Produces a pretreated phosphate pebble that has distinct advantages over untreated phosphate pebble in the acidulation process steps.

Additional benefits due to this pretreatment process step extend into the acidulation process step. Extraction of the calcium carbonate from the phosphate rock prior to acidulation reduces consumption of sulfuric acid, forms less gypsum waste, avoids water consumption in formation of the gypsum waste and reduces foaming from carbon dioxide evolution. Extraction of the magnesium carbonate prior to acidulation avoids problems in both the acidulation process and subsequent products. Magnesium stays with the phosphoric acid and strongly increases viscosity. Magnesium forms precipitates in phosphate products that limits product quality.

This invention provides a pretreatment process for phosphate rock than can improve the $P_2O_5$ content by 6–7 BPL units while removing all or part of the magnesium and reducing the excess calcium to acceptable levels for use of the rock as feed into the acidulation process step of wet process phosphoric acid production. Composition of the phosphate rock in terms of phosphorous, calcium and magnesium $P_2O_5$, CaO, MgO is the primary selection criterion for use of an ore for phosphoric acid production. Ore having a $P_2O_5$ content less than 26% by weight (BPL grade less than 56%) is not a suitable feedstock (Becker, 1983). As a result the lower $P_2O_5$ limit for a feed to this pretreatment process is about 22% while an upper limit of about 36% represents a level in which the content of leachable impurities decreases the extent of available improvement. As a preacidulation feedstock the preferred $P_2O_5$ content is about 28%. Magnesium has an upper limit of 0.6% by weight as MgO in phosphate rock feed to acid production. This process can reduce phosphate rock having as much as 5% MgO to acceptable levels (less than 0.6%). A preferred MgO content in the pretreatment feed is around 2% but this value is tied to the combined MgO and CaO content. Calcium in the phosphate rock in excess of a molar ratio of $CaO/P_2O_5$ at 3 represents impurities. This pretreatment process can reduce this molar ratio from around 5 to 3.

The strong hydrogen form cation-exchange resins for use in practicing the present invention are strong acid cation-exchange resins preferably in the form of macroporous beads, and can exchange at a pH less than 2.5. The resins contain exchange sites which can be used in hydrogen ($H^+$), ammonium ($NH_4^+$), or mixed hydrogen-ammonium ($H^+$/NH4$^+$) forms. The selected resin beads should have adequate mechanical strength for use in the system, and they should be resistant to phosphoric and sulfuric acids as well as the osmotic shock as encountered in such a system. Styrene-base cation resins are especially suitable. For example, crosslinked polystyrene vinyl sulfonate resins may be used. An example of a suitable commercial resin is Dowex 50Wx8. These resins can either be purchased in selectd sizes to meet the classification criteria needed or packaged in small porous containers to present package sizes that can be effectively separated from the rock.

Since this process is intended primarily as a pretreatment of phosphate rock, the grinding and classification of the phosphate rock should meet the acidulation process requirements. The requirements vary for rock from different sources. In general, crushing type comminution treatment is preferred over impact type but both techniques provide rock that is suitable for pretreatment.

Size reduction of the rock by crushing techniques does not fragment the phosphate component as much as the carbonate and as a result the carbonate fragments present more surface area for leaching the magnesium and calcium. There is no preference between wet or dry grinding. Typical requirements for phosphate rock acidulation feed are about 98% passage through a 35 mesh sieve (particle size less than 500 microns). A preferred rock size for the pretreatment would be about 98% passage through a 60 mesh sieve (particle size less than 250 microns) because a 20–50 mesh ion exchange resin bead size is readily available from commercial sources.

The mixing of the phosphate rock with the ion exchange material followed by quantitative separation and recovery of the ion exchange material from the phosphate rock is a feature of this process. Two options have been found to be equally effective. The ion exchange material can be classified to have either a larger or smaller particle size distribution relative to that of the phosphate rock. The preferred criteria is that the two particle size distributions have less than about two wt. percent overlap in order to make a quantitative separation and recovery. Phosphate rock feed to the acidulation process step typically has a particle size distribution with particles 30–40% by weight larger than 125 microns. Classification of phosphate rock by wet sieving was found to provide size distributions for a given size mesh wire screen to allow matching the phosphate rock of 250–500 microns size range with ion exchange resin of 74–149 micron size range to obtain non-overlapping classifications. Alternatively phosphate rock particles of 62–250 microns size range are matched with ion exchange resin particles of 300–800 microns size range to obtain non-overlapping particle size distributions. For these size classifications, a 60 mesh sieve (250 micron opening) is used to separate the phosphate rock from ion exchange resin, while a 230 mesh sieve (63 micron opening) is used to separate the solids from the leach liquor. Some suspended clay and organic matter will remain in the liquor.

The direct contact of phosphate rock with ion exchange resin in a slurry within the leaching step overcomes several problems that are associated with the alternative use of separate reactor beds for the phosphate rock and for the ion exchange resin coupled by a circulating leach liquor. First, the residence time for calcium and magnesium in the leach liquor is much shorter in the mixed slurry composition. Calcium and magnesium do not have a chance to become saturated and precipitate as a scale on the process equipment. Carbonic acid is the primary leaching acid in this medium and evolution of carbon dioxide causes the solubility equilibrium to shift toward precipitation. Other problems arise from the solid-liquid separation requirements and the movement of the leach liquor through two reactors at a rate sufficient to match the leaching rate.

The preferred weight ratio between resin and phosphate rock is based upon the quantitative exchange between the phosphate rock and the ion exchange resin as to the extent of the capacity of the resin. As a result, the preferred weight ratio of ion exchange resin to phosphate rock depends upon the phosphate rock composition and the capacity of the ion exchange resin and is in the range of about 2/1 to 2/3 . This ratio can be determined from the relationship below:

$$R=\frac{W_R}{W_P}=\left[\frac{M_{CaO}+M_{MgO}}{M_{P_2O_5}}-X\right][M_{P_2O_5}]\left[\frac{2}{C_R}\right]$$

wherein the symbols are defined as follows:

$2/C_R$—ratio of equivalents/mole for Ca and Mg to capacity of ion exchange resin as equivalents/100 gm resin $W_R$—mass of resin $W_P$—mass of phosphate rock $M_{CaO}$—moles of CaO/100 g phosphate rock $M_{MgO}$—moles of MgO/100 g phosphate rock $M_{P2O5}$—moles of $P_2O_5$/100 g phosphate rock X—$CaO/P_2O_5$ molar ratio of product ranging from 1 to 3

Simple mechanical agitation is sufficient to keep the solids suspended and allow excess carbon dioxide to escape the aqueous slurry. Suspensions of 10–45% solids have been observed without any adverse effects on the ion transfer between solids or the escape of carbon dioxide. Higher levels of suspended solids could be effective in ion transfer, but the wet screening to separate the phosphate rock, ion exchange resin and the leaching liquor can be hampered by the low water levels.

The leaching and ion exchange reaction are rapid such that an optimum contact time is about 30 minutes. Several events are present which indicate that the resin has been exchanged to capacity and little further reaction is taking place. First, the rate of evolution of carbon dioxide decreases to near non detectable levels based upon time based observation of weight loss. Next, the pH increases from a low of 1.6 to above 2.5 depending upon the ratio of resin to rock. A terminal pH above 3 is preferred in order to avoid loss of $P_2O_5$ from the phosphate rock.

Reaction conditions at ambient temperature and pressure have been particularly effective. The ion exchange resins are capable of ion exchanging between about 4° and 77° C. Since the calcium and magnesium are quantitatively loaded onto the ion exchange resin at room temperature (23°–25° C.), there is no advantage at higher or lower temperatures.

It should be noted that most of the numeric limitations are based on economic cost benefit considerations and the skilled in the art will be able to choose specific figures.

Methods for separation of the phosphate rock, ion exchange resins and leach liquor have been shown to be effective for quantitatively recovering the leaching components. Wet sieving the mixture results in a separation of the phosphate rock, loaded ion exchange resin and leaching liquor into separate process streams. The phosphate rock is moved out of the process as a treated phosphate rock. The loaded resin can be further processed in a two-step regeneration treatment.

A two-step regeneration of the loaded cation-exchange resin is one of the convenient advantages of this invention. Acid consumption required in the regeneration of the cation-exchange resin is recovered as an ammonium salt product. Ammonium salt/ammonia solution is used to displace the calcium, magnesium and other trace metals from the loaded cation-exchange resin. The resin, as the ammonium form, is then treated with acid to displace the ammonium ion and replace it with hydrogen ion. The ammonium ion acts to partition the calcium, magnesium and trace metal ions from the regeneration of the acid form cation-exchange resin.

The cation-exchange resin, as loaded with calcium, magnesium and other trace metals, is treated with an ammonium salt solution. Both calcium and magnesium can be displaced from the ion exchange resin at the same time with an ammonium salt solution concentration greater than 2 molar without attempting to separate the two metal ions. Processing to separate calcium and magnesium can be carried out on the first step regeneration liquor. Ammonium nitrate is the preferred ammonium salt although other ammonium salts such as ammonium acetate and ammonium chloride will work.

The liquor formed in the first step regeneration contains magnesium, calcium and ammonium ions and is further processed to recover the ammonium salt solution as well as the magnesium and calcium as products. Two options exist for the magnesium and calcium processing. Either the step one regeneration liquor is processed to obtain separate purified magnesium and calcium compounds or the magnesium and calcium can be recovered together as a valuable agricultural product. Magnesium can be separated from the resultant liquor by addition of either ammonium hydroxide or calcium hydroxide (or calcium oxide) to raise the pH above 10. Magnesium hydroxide precipitates and can be filtered from the solution. The remaining calcium can be precipitated from solution by the addition of carbon dioxide to form calcium carbonate. The ammonium salt remaining in solution can be recycled along with makeup ammonium salt in the first step regeneration cycle.

Further regeneration of the ammonium form cation-exchange resin to the hydrogen form is carried out in a second step. In this step either 3 molar phosphoric acid or 3 molar sulfuric acid is used to exchange the hydrogen ion for ammonium ion on the cation-exchange resin. The resultant acid form cation-exchange resin is rinsed with water and recycled to the leaching cycle. The ammonium-acid liquor can be further processed to form a fertilizer product. Neutralization of this ammonium-acid stream with additional ammonia and/or potassium hydroxide leads to a valuable fertilizer product. Consumption of the ammonia and acid in this process leads directly to a valuable product rather than becoming a cost factor.

The purpose of the two-step regeneration of the ion exchange resin is to recover the acid consumed in the second regeneration step as a useful product. Selection of ammonium ion for the first regeneration step satisfies this purpose because either an ammonium phosphate/phosphoric acid or an ammonium sulfate/sulfuric acid intermediate product could be utilized for production of either ammonium phosphate or ammonium sulfate products. Alternatively, other first step regeneration ions such as potassium could be used in order to obtain different products.

This invention is particularly effective in selectively and nearly quantitatively extracting the calcium and magnesium carbonates from phosphate rock contaminated with dolomite, calcite, magnetite or other minerals of these two compounds. Phosphate rock having a combined molar ratio CaO and MgO to $P_2O_5$ greater than 3 but less than 5 with a $P_2O_5$ concentration at least 22% can be advantageously treated. The tricalcium phosphate (referred to as BPL—bone phosphate of lime) is only slightly affected by this treatment but receives the benefit of enhanced concentration in the acidulation feedstock composition as a result of the extraction of the carbonate fraction. The treated phosphate rock can have a CaO to $P_2O_5$ molar ratio of 2.3–3.4 after this treatment.

The chemistry of this process can be divided into leaching, regeneration and product recovery parts. The leaching chemistry involved in this invention is illustrated in the following reactions:

$$1.5<pH<3$$

$$MgCO_3+H\text{-Resin}\rightarrow Mg\text{-Resin}+CO_2+H_2O$$

$$CaCO_3+H\text{-Resin}\rightarrow Ca\text{-Resin}+CO_2+H_2O$$

The extent of this reaction is limited only by the available exchange sites on the resin. The reaction rate is limited by the dissolution of the carbonates into solution. Under optimum conditions, the calcium and magnesium carbonates are exchanged completely to produce a phosphate rock that is free of the carbonates of magnesium and calcium. The loaded resin and phosphate rock are separated and the phosphate rock product is removed from this process. The loaded resin is further processed through two regeneration steps. The chemistry of the regeneration is shown:

$$Mg\text{-Resin}+NH_4NO_3/NH_3\rightarrow Mg(NO_3)_2+NH_4\text{-Resin}$$

$$Ca\text{-Resin}+NH_4NO_3/NH_3\rightarrow Ca(NO_3)_2+NH_4\text{-Resin}$$

The calcium and magnesium on the resin are exchanged with ammonium ion in solution. A second regeneration step is used to react concentrated acid (3–6M sulfuric or phosphoric) solution to regenerate the resin to the acid form as follows:

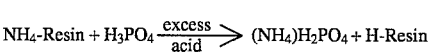

$$NH_4\text{-Resin} + H_3PO_4 \xrightarrow[\text{acid}]{\text{excess}} (NH_4)H_2PO_4 + \text{H-Resin}$$

The ammonium phosphate solution is separated from the resin and can be further processed to become a product. The resin has been returned to the acid form and is recycled back to the leaching treatment.

The magnesium and calcium brine formed in the regeneration steps can be further processed to separate magnesium and then calcium using ammonia and carbon dioxide to adjust pH. Magnesium is precipitated as the hydroxide by addition of either calcium hydroxide or ammonia to raise pH to 10.

pH 10–12

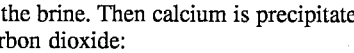

$$Mg(NO_3)_2+2NH_4OH \rightarrow Mg(OH)_2+2NH_4NO_3$$

Magnesium hydroxide is allowed to settle and is filtered from the brine. Then calcium is precipitated by the addition of carbon dioxide:

pH 8–10

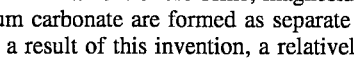

$$Ca(OH)_2+CO_2 \rightarrow CaCO_3+H_2O$$

In this treatment of the brine, magnesium hydroxide and calcium carbonate are formed as separate products.

As a result of this invention, a relatively carbonate-free, magnesium-free and a lower calcium-level phosphate rock is produced. Other products include magnesium hydroxide, calcium carbonate, and an ammonium phosphate or ammonium sulfate salt.

DESCRIPTION OF PREFERRED EMBODIMENTS

Brief Description of the Drawing

The method of the present invention is preferably utilized with the 3 loops process scheme illustrated in FIG. 1. The three loops as shown include a phosphate rock leaching loop, by-product recovery loop, and an ion-exchange regeneration loop. In the first loop, phosphate rock size-classified according to requirements as feed to the wet process for phosphoric acid production (typically 80–200 microns) is fed into a leaching chamber (unit 10). At the same time a non-overlapping size classified hydrogen form cation-exchange resin is fed into the leaching chamber along with enough water to make a slurry of at least 30% solids by weight. The mixture of ion exchange resin, phosphate rock and liquor are agitated and after a sufficient residence time of preferably 30 minutes and an adjusted liquor pH>3, the slurry is transferred to a separation unit (unit 11). This unit can be a simple wet screening system that separates the resin and phosphate rock into different streams on the basis of particle size. There is very little size degradation of the phosphate rock resulting from this treatment. The process water which still contains suspended fine particles of clay, organics and silica is directed toward a settling chamber (unit 12) where it is clarified and recycled back to the leaching chamber. The sediments of clay, silica and organics are discarded as mud. Usually this quantity of mud is approximately 1% of the phosphate rock feed. The treated phosphate rock is removed from the process as a finished product, thus completing the phosphate rock leaching loop.

The ion exchange resin, loaded with predominantly calcium and magnesium, is transferred to the first regeneration chamber (unit 13) where ammonium nitrate solution, preferably of a concentration between 160–320 g/l, is used to displace the calcium and magnesium from the resin into solution. The solution is moved to a precipitation chamber (unit 14) where it is mixed with ammonia or calcium hydroxide to selectively precipitate magnesium hydroxide at a pH of 10. The magnesium hydroxide is allowed to settle and is filtered from the slurry at unit 15. The filtrate is sent to another precipitation chamber (unit 16) where carbon dioxide is reacted with the dissolved calcium to precipitate calcium carbonate. Calcium carbonate is allowed to settle and is filtered from the slurry at unit 17. The filtrate from this step is essentially a solution of ammonium nitrate and is used for recycle. Some ammonium ion has been consumed by the ion exchange resin and this amount is added to the recycled regeneration solution before it is returned to the first regeneration chamber (unit 13). Magnesium hydroxide and calcium carbonate are separately collected as products and dried.

After the first regeneration in chamber unit 13, the ion exchange resin is moved to regeneration chamber unit 18 for treatment with 20–30% phosphoric acid or sulfuric acid to restore the ion exchange resin to the hydrogen form cation-exchange resin and to collect the ammonium ion consumed in the first regeneration as an ammonium salt. The second regeneration step produces a solution containing a mixture of ammonium salt and either phosphoric acid or sulfuric acid which can be further processed to a desirable product and avoid a process loss of either ammonia or acid. The regeneration loop is completed when the hydrogen form cation-exchange resin is transferred to the leaching chamber (unit 10) and the product recovery loop is completed when the ammonia and acid used in the two regeneration steps lead to the recovery of magnesium hydroxide, calcium carbonate and either ammonium phosphate/phosphoric acid or ammonium sulfate/sulfuric acid product intermediate.

This invention and its advantages will be better understood by reference to the following examples.

EXAMPLE 1

This example illustrates the process of the invention for leaching the carbonates of magnesium and calcium from phosphate pebble in a single extraction/ion transfer step. A dolomite-rich phosphate pebble was first ground and classified into selected sieve sizes. Chemical analyses of the sieve fractions were determined as follows in Table 1.

TABLE 1

Composition of Phosphate Pebble Feedstock.

| Feedstock Sample | Number | Acid Insolubles % w/w | MgO % w/w | CaO % w/w | $P_2O_5$ % w/w |
|---|---|---|---|---|---|
| 18/35 | 1 | 7.52 | 1.71 | 39.43 | 22.65 |
| 35/60 | 2 | 11.41 | 1.62 | 42.77 | 25.82 |
| 60/120 | 3 | 14.83 | 1.50 | 40.35 | 25.10 |
| 120/230 | 4 | 9.91 | 2.97 | 42.21 | 23.08 |
| −230 | 5 | 4.98 | 4.43 | 44.07 | 21.05 |

These feedstocks were leached by the extraction/ion transfer technique in accordance with the process of the invention. Determination of the carbon dioxide, magnesium, calcium and phosphorus pentoxide by spectroscopic, wet chemical and thermal methods of chemical analysis served to monitor the extent of the leaching and the efficiency of the ion transfer to the ion exchange resin.

Samples of the feedstocks to be leached were combined with the H form cation exchange resin and water in an open and stirred vessel. The extractions were carried out at ambient temperature and pressure. The leaching conditions are summarized in Table 2. The relative quantities of pebble, resin and water were varied to give different slurry compositions. Pebble size, resin bead size, contact time, pH and relative amounts of pebble to resin were varied in order to observe the leaching process. After leaching, the treated phosphate pebble, the ion exchange resin and the aqueous solution were separated from each other by means of wet sieving through mesh sizes that would partition each component. Extent of pebble leaching was determined by the weight percent lost during the extraction. Handling losses of the pebble were less than 2% w/w.

Analyses of the recovered phosphate pebble sample showed that calcium, magnesium, carbon dioxide, phosphorus and some other trace components were extracted. Composition of the treated phosphate pebble and the percent change are summarized in Table 3. Extraction of the calcium, magnesium and carbon dioxide associated with the dolomite component of the phosphate pebble accounted for the bulk of the pebble leaching. These leached samples of phosphate pebble represent three levels of severity in leaching based upon the relative amount of the ion exchange resin to phosphate rock available for ion transfer.

small when compared with the amount of calcium extracted but there is a large calcium component available for extraction. Even though there is an improvement in the phosphorus content of the treated phosphate rock there is some phosphate lost to leaching. Improvement of the phosphorus content in the phosphate pebble is more favorable when the pH of the leach liquor at the end of the leaching is above 2.5.

Ion transfer from the phosphate pebble to the ion exchange resin in the single step leaching in accordance with the invention was limited by the capacity of the resin to hold ions. Ion exchange resin samples from the single step leaching treatments in Table 2 were recovered and treated with a 2–3 molar ammonium salt solution and/or 2–3 molar hydrochloric acid solution to recover calcium and magnesium as well as other ions loaded on the ion exchange resin. The liquor containing the calcium and magnesium recovered from the ion exchange resin has a concentration of approximately 11 g Ca/l and 0.92 g Mg/l as ions. No attempt was made to separately recover calcium and magnesium. These results are summarized in Table 4 as follows. The calcium and magnesium account for nearly all of the available ion exchange ion exchange resin average capacity of 3.40±0.48 meq/gm capacity occupied by the calcium and magnesium ions. This ion capacity compares favorably with the hydrogen ion capacity of the ion exchange resin determined to be 3.32 meq/gm by titration with sodium hydroxide. The 14% uncertainty in the ion-exchange resin capacity is due to contributions from calcium and magnesium analyses and from resin moisture levels. Attempts to oven dry the resin to

TABLE 2

Summary of Single Stage Leaching of Phosphate Rock at Ambient Temperature.

| Experiment | Feedstock | Median pH | Leaching Time (minutes) | Slurry % Solids (w/w) | Ratio, Wt. (Resin/ Rock) | Pebble Size (mesh) | Resin Size (mesh) | Pebble Leached % w/w |
|---|---|---|---|---|---|---|---|---|
| 913 | 2 | 2.2 | 30 | 18.1 | 1.74 | 35–60 | 100–200 | 37.48 |
| 914 | 1 | 2.6 | 30 | 12.0 | 1.03 | 18–35 | 100–200 | 24.02 |
| 1025A | 3 | 3.4 | 30 | 23.3 | 0.49 | 60–120 | 20–50 | 7.41 |
| 101 | 3 | 2.6 | 30 | 16.8 | 0.99 | 60–120 | 20–50 | 19.00 |
| 66 | 5 | 4.5 | 60 | 16.7 | 1.00 | −230 | 20–50 | 19.60 |
| 67 | 3 | 2.7 | 60 | 16.8 | 0.98 | 60–120 | 100–200 | 24.17 |
| 920 | 1 | 2.4 | 60 | 44.3 | 1.66 | 18–35 | 200–300 | 26.19 |
| 1011 | 4 | 2.0 | 30 | 37.5 | 2.00 | 120–130 | 20–50 | 35.79 |

On the basis of these data much of the magnesium extraction occurs after the bulk of the calcium as a carbonate is extracted. Overall magnesium, carbon dioxide and calcium levels in the phosphate pebble are lowered while the phosphorus level increases as a result of this extraction. Actual quantities of magnesium extracted are relatively a constant weight caused the resin to decompose or degrade, therefore air dried weight has been used as the basis for comparison. Ion exchange stoichiometry is based upon the initial weight of the ion exchange resin. The observed values of the ion exchange capacity of these resins are about 60% of the reported value.

TABLE 3

Composition of Treated Phosphate Pebble.

| Experiment | 920 | 913 | 1011 | 101 | 66 | 1025A | 67 | 914 |
|---|---|---|---|---|---|---|---|---|
| Feedstock | 1 | 2 | 4 | 3 | 5 | 3 | 1 | 1 |
| $P_2O_5$(% w/w) | 29.36 | 26.09 | 25.39 | 25.85 | 23.50 | 24.87 | 28.59 | 26.70 |
| BPL (% w/w) | 64.2 | 57.0 | 55.5 | 56.6 | 51.3 | 54.4 | 62.5 | 58.4 |
| BPL % Improvement | 8.0 | 7.5 | 5.1 | 7.0 | 5.3 | 4.9 | 6.3 | 8.9 |
| MgO (% w/w) | 0.81 | 0.69 | 0.40 | 1.02 | 0.50 | 1.34 | 0.63 | 1.35 |
| MgO % Change | −53 | −60 | −87 | −29 | −89 | −6.9 | −63 | −2.1 |
| CaO (% w/w) | 27.1 | 39.5 | 28.1 | 39.7 | 32.0 | 40.2 | 29.9 | 43.1 |
| CaO Change | 31 | −9.5 | −33 | −4.4 | −27 | −3.1 | −24 | −3.7 |

TABLE 3-continued

| Experiment | Composition of Treated Phosphate Pebble. | | | | | | | |
|---|---|---|---|---|---|---|---|---|
| | 920 | 913 | 1011 | 101 | 66 | 1025A | 67 | 914 |
| $CO_2$ (% w/w) | — | 4.90 | — | 5.02 | — | 6.2 | — | 6.12 |
| $CO_2$change | — | −42.8 | — | −36.2 | — | 21.1 | — | — 22.5 |

The leaching liquor contains some leached calcium and magnesium along with dissolved carbon dioxide and phosphorus pentoxide as carbonate and phosphate ions in solution. Concentration of the calcium and magnesium remaining in the leaching liquor after separation of solids varies widely but approximately 0.3 g Ca/l and 0.15 g Mg/l are still in the leaching liquor. The contribution of the dissolved magnesium in the leach liquor is small but important in overall removal of magnesium from the phosphate rock. Other ions such as iron and trace metals are also loaded on to the ion exchange resin at trace levels.

Instead of cation-exchange resins, supported chelating or complexing agents having a greater capacity and selectivity will be adaptable to the process. Flotation can also be suitable for separation.

TABLE 4

Transfer of Calcium and Magnesium To Ion-Exchange Resin.

| Experiment | Mole Ratio (Ca/Mg) | Moles Mg++ | Moles Ca++ | Resin Capacity (meq/gm) |
|---|---|---|---|---|
| 913 | 11.3 | 0.0170 | 0.1920 | 3.96 |
| 914 | 11.5 | 0.0085 | 0.0980 | 4.10 |
| 922 | 9.2 | 0.0077 | 0.0706 | 3.08 |
| 101 | 10.9 | 0.0077 | 0.0843 | 3.67 |
| 1025A | 1.0 | 0.0025 | 0.0399 | 3.39 |
| 1011B | 12.2 | 0.0209 | 0.2569 | 2.77 |
| 066 | 5.9 | 0.0122 | 0.0722 | 3.37 |
| 067 | 11.7 | 0.0068 | 0.0798 | 3.44 |

The advantages of this invention will be apparent to those skilled in the art. Relatively carbonate-free, magnesium free products suitable directly for fertilizer, or acceptable feed to acidulation are obtained. Other valuable products such as magnesium hydroxide, calcium carbonate and an ammonium salt such as monoammonium phosphate are also credits in the process.

It is to be understood that this invention is not limited to the specific examples which have been offered as particular embodiments and that modifications can be made without departing from the spirit thereof.

Now that the invention has been described, what is claimed is:

1. A pretreatment process for extraction of magnesium carbonate and calcium carbonate from solid phosphate rock with a strong hydrogen form cation exchange resin, prior to acidulation of the phosphate rock with a mineral acid, which comprises the steps of: (1) classifying the phosphate rock and the cation exchange resin into substantially non-overlapping particle size distributions; (2) forming a slurry consisting of phosphate rock and water and the cation exchange resin; (3) agitating the slurry to leach calcium and magnesium carbonates from the phosphate rock and load calcium and magnesium onto the cation exchange resin, and (4) separating the slurry into a leached phosphate rock composition, and a calcium and magnesium loaded cation exchange resin, and an aqueous solution of dissolved calcium and magnesium carbonates.

2. The process of claim 1 in which the phosphate rock has a $P_2O_5$ content in the range of about 22 to 36 wt. %.

3. The process of claim 2 in which the phosphate rock and the resin have less than about 2 wt. % particle size overlap.

4. The process of claim 1 in which the ratio of resin to phosphate rock in the slurry is in the range of about 2/1to 2/3.

5. The process of claim 4 in which 98% of the phosphate rock passes through a 60 mesh sieve.

6. The process of claim 1, comprising the steps of regenerating the cation exchange resin and recycling same to step (1) the process.

* * * * *

UNITED STATES PATENT AND TRADEMARK OFFICE

CERTIFICATE OF CORRECTION

PATENT NO. : 5,500,193

DATED : March 19, 1996

INVENTOR(S) : Robert F. Benson and Dean F. Martin

It is certified that error appears in the above-indentified patent and that said Letters Patent is hereby corrected as shown below:

Column 10, beginning at line 52 and continuing through column 11, line 9, please delete the entire Table 3 and insert as follows:

Signed and Sealed this

Twenty-fifth Day of June, 1996

*Attest:*

Bruce Lehman

BRUCE LEHMAN

*Attesting Officer*

*Commissioner of Patents and Trademarks*

Table 3

Composition of Treated Phosphate Pebble.

| Experiment | 920 | 913 | 1011 | 101 | 66 | 1025A | 67 | 914 |
|---|---|---|---|---|---|---|---|---|
| Feedstock | 1 | 2 | 4 | 3 | 5 | 3 | 1 | 1 |
| $P_2O_5$ (% w/w) | 29.36 | 26.09 | 25.39 | 25.85 | 23.50 | 24.87 | 28.59 | 26.70 |
| BPL (% w/w) | 64.2 | 57.0 | 55.5 | 56.6 | 51.3 | 54.4 | 62.5 | 58.4 |
| BPL % Improvement | 8.0 | 7.5 | 5.1 | 7.0 | 5.3 | 4.9 | 6.3 | 8.9 |
| MgO (% w/w) | 0.81 | 0.69 | 0.40 | 1.02 | 0.50 | 1.34 | 0.63 | 1.35 |
| MgO % Change | -53 | -60 | -87 | -29 | -69 | -6.9 | -63 | -2.1 |
| CaO (% w/w) | 27.1 | 39.5 | 28.1 | 39.7 | 32.0 | 40.2 | 29.9 | 43.1 |
| CaO Change | -31 | -9.5 | -33 | -4.4 | -27 | -3.1 | -24 | -3.7 |
| $CO_2$ (% w/w) | ---- | 4.90 | ---- | 5.02 | ---- | 6.22 | ---- | 6.12 |
| $CO_2$ Change | ---- | -42.8 | ---- | -36.2 | ---- | -21.1 | ---- | -22.5 |

Column 11, lines 27-42, please delete the entire Table 4 and insert as follows:

Table 4

Transfer of Calcium and Magnesium To Ion-Exchange Resin.

| Experiment | Mole Ratio (Ca/Mg) | Moles Mg++ | Moles Ca++ | Resin Capacity (meq/gm) |
|---|---|---|---|---|
| 913 | 11.3 | 0.0170 | 0.1920 | 3.96 |
| 914 | 11.5 | 0.0085 | 0.0980 | 4.10 |
| 922 | 9.2 | 0.0077 | 0.0706 | 3.08 |
| 101 | 10.9 | 0.0077 | 0.0843 | 3.67 |
| 1025A | 16.0 | 0.0025 | 0.0399 | 3.39 |
| 1011B | 12.2 | 0.0209 | 0.2569 | 2.77 |
| 066 | 5.9 | 0.0122 | 0.0722 | 3.37 |
| 067 | 11.7 | 0.0068 | 0.0798 | 3.44 |